US005817606A

United States Patent [19]

Kinker et al.

[11] Patent Number: 5,817,606

[45] Date of Patent: Oct. 6, 1998

[54] VISCOSITY INDEX IMPROVING ADDITIVES FOR PHOSPHATE ESTER-CONTAINING HYDRAULIC FLUIDS

[75] Inventors: Bernard George Kinker, Kintnersville; Robert Howard Gore, Southampton; Charles William Hyndman, Hatfield; Bridget Marie Stevens, Horsham, all of Pa.

[73] Assignee: Rohm and Haas Company, Philadelphia, Pa.

[21] Appl. No.: 900,221

[22] Filed: Jul. 24, 1997

Related U.S. Application Data

[60] Provisional application No. 60/023,740, Aug. 8, 1996.

[51] Int. Cl.[6] ..... C10M 161/00

[52] U.S. Cl. ..... 508/440; 252/78.5

[58] Field of Search ..... 252/78.5; 508/440

[56] References Cited

U.S. PATENT DOCUMENTS

| | | | |
|---|---|---|---|
| 2,834,733 | 5/1958 | Moreton | 252/78.5 |
| 3,057,803 | 10/1962 | Benz et al. | 252/78.5 |
| 3,679,587 | 7/1972 | Smith | 252/78.5 |
| 3,707,500 | 12/1972 | Romano et al. | 252/78.5 |
| 3,718,596 | 2/1973 | Richard, Jr. | 252/78 |
| 4,519,932 | 5/1985 | Schnur et al. | 252/78.5 |
| 5,464,551 | 11/1995 | Deetman | 252/78.5 |

FOREIGN PATENT DOCUMENTS

96/17517 6/1996 WIPO .

*Primary Examiner*—Jacqueline V. Howard
*Attorney, Agent, or Firm*—Thomas J. Howell

[57] ABSTRACT

Polymer compositions derived from selected alkyl (meth) acrylate ester monomers used in certain weight ratios to provide improved viscosity control and low temperature performance characteristics in phosphate ester aircraft hydraulic fluids is disclosed. Polymer compositions for use as viscosity index improving additives in aircraft hydraulic fluids contain from 40 to 100 weight percent ($C_1$–$C_{10}$)alkyl (meth)acrylate and zero to 60 weight percent ($C_{11}$–$C_{20}$)alkyl (meth)acrylate monomer units. Preferred polymer compositions based on 40 to 70 weight percent ($C_1$–$C_{10}$)alkyl (meth)acrylate and 30 to 60 weight percent ($C_{11}$–$C_{15}$)alkyl (meth)acrylate monomer units combine good solubility in the phosphate ester hydraulic fluids with good viscosity control at low and high temperatures.

9 Claims, No Drawings

VISCOSITY INDEX IMPROVING ADDITIVES FOR PHOSPHATE ESTER-CONTAINING HYDRAULIC FLUIDS

Prov. application 60/023,740, filed Aug. 8, 1996.

BACKGROUND OF THE INVENTION

This invention relates to the use of polymer compositions based on selected alkyl (meth)acrylate monomers combined in certain weight ratios as additives to phosphate ester-based functional fluids for providing viscosity index improvement and low temperature performance in aircraft hydraulic fluids. The polymer additives are normally dissolved or dispersed in the phosphate ester-based fluids for eventual incorporation into aircraft hydraulic fluid compositions.

Functional fluids have found use as electronic coolants, diffusion pump fluids, damping fluids, heat transfer fluids, heat pump fluids, refrigeration fluids power transmission and hydraulic fluids. Hydraulic fluids intended for use in the hydraulic systems of aircraft, for example, for the operation of various mechanisms and control systems, must satisfy a variety of performance requirements. Among these requirements are good thermal stability, fire-resistance, low susceptibility to viscosity changes over a wide range of temperatures, and good fluidity at low temperatures. Viscosity index (or VI) is a measure of the degree of viscosity change as a function of temperature; high viscosity index values indicate a smaller change in viscosity with temperature variation compared to low viscosity index values. Viscosity index improver additives having high viscosity index values coupled with good low temperature fluidity allow the hyraulic fluid to flow at the lowest possible temperature of operation, such as at high altitude flight conditions, while providing satisfactory viscosity performance at higher operating temperatures.

Polymeric additives have been used to improve the performance of automobile engine lubricating oils in regard to high and low temperature viscosity characteristics. However, the functional fluids required for use in aircraft hydraulic systems are compositionally different from conventional automobile lubricating oils, such that the polymeric additives suitable for automobile engine lubricating oils are not satisfactory for use in the aircraft fluids. For example, phosphate ester fluids are of interest for use in aircraft systems because of their fire-resistant properties; however, lack of solubility in these phosphate ester-based fluids precludes the use of conventional automobile engine VI improving additives in aircraft hydraulic fluids.

U.S. Pat. No. 3,718,596 discloses the use of a mixture of high (15,000 to 40,000) and low (2,500 to 12,000) molecular weight alkyl (meth)acrylate polymers as VI improving additives in phosphate ester-based fluids to provide resistance to erosion of mechanical parts exposed to the phosphate ester fluids. Poly(butyl methacrylate) and poly(hexyl methacrylate) polymers were disclosed as high and low molecular weight polymers, respectively, for use as VI improving additives.

U.S. Pat. No. 5,464,551 discloses aircraft hydraulic fluid compositions having improved thermal, hydrolytic and oxidative stability characteristics where the phosphate ester-based compositions contain different additives that function as acid scavenger, anti-erosion agent, viscosity index improver and antioxidant. Suitable VI improving additives disclosed were poly(alkyl methacrylates) of the type described in U.S. Pat. No. 3,718,596, but with higher molecular weights (50,000 to 100,000 number average molecular weight), and where the repeating units of the poly(alkyl methacrylate) substantially comprise butyl and hexyl methacrylate.

Poly(butyl methacrylate) and poly(butyl methacrylate/dodecyl-pentadecyl methacrylate//67/33) compositions are commercially available VI improving additives prepared by conventional solution polymerization processes.

None of these previous approaches combines good viscosity index, compatibility with the phosphate ester fluids, good high temperature thickening ability at low usage levels and low temperature fluidity in a single polymer additive; it is an object of the present invention to provide this combination of properties in a single polymer additive.

SUMMARY OF THE INVENTION

The present invention provides a hydraulic fluid composition comprising (a) a phosphate ester base fluid comprising one or more trialkyl phosphate esters, wherein alkyl groups of the phosphate ester contain 4 to 5 carbon atoms; (b) from 1 to 15 percent, based on total hydraulic fluid composition weight, of a viscosity index improving polymer comprising monomer units of: (i) from 40 to 100 percent, based on total polymer weight, of monomer selected from one or more ($C_1$–$C_{10}$)alkyl (meth)acrylates, wherein the ($C_1$–$C_{10}$)alkyl (meth)acrylate comprises from zero to 75 percent, based on total polymer weight, of monomer selected from one or more ($C_1$–$C_2$)alkyl (meth)acrylates; from zero to 75 percent, based on total polymer weight, of monomer selected from one or more ($C_3$–$C_5$)alkyl (meth)acrylates; from zero to 75 percent, based on total polymer weight, of monomer selected from one or more ($C_6$–$C_{10}$)alkyl (meth)acrylates; and at least 20 percent, based on total polymer weight, of combined ($C_1$–$C_2$)alkyl (meth)acrylate and ($C_3$–$C_5$)alkyl (meth)acrylate monomers; and (ii) from zero to 60 percent, based on total polymer weight, of monomer selected from one or more ($C_{11}$–$C_{20}$)alkyl (meth)acrylates; and (c) from 0.1 to 20 percent, based on total hydraulic fluid composition weight, of auxiliary additives selected from one or more antioxidants, acid scavengers and anti-erosion additives; wherein relative amounts of the phosphate ester base fluid, the viscosity index improving polymer and the auxiliary additives are selected such that the hydraulic fluid composition exhibits a viscosity of at least 3 square millimeters/second at 210° F. and less than 4,000 square millimeters/second at −65° F.; and provided that the ($C_3$–$C_5$)alkyl (meth)acrylate of the viscosity index improving polymer is less than 60 percent n-butyl methacrylate when the ($C_{11}$–$C_{20}$)alkyl (meth)acrylate of the viscosity index improving polymer is greater than 30 percent dodecyl-pentadecyl methacrylate or the ($C_6$–$C_{10}$)alkyl (meth) acrylate of the viscosity index improving polymer is greater than 30 percent hexyl methacrylate, based on total polymer weight.

The present invention also provides a method for stabilizing the viscosity characteristics of a hydraulic fluid comprising adding from 1 to 15 percent, based on total hydraulic fluid composition weight, of a viscosity index improving polymer, as described above, to a phosphate ester base fluid wherein the hydraulic fluid comprises (i) one or more trialkyl phosphate esters, as described above, and (ii) from 0.1 to 20 percent, based on total hydraulic fluid composition weight, of auxiliary additives, as described above; wherein relative amounts of the phosphate ester base fluid, the viscosity index improving polymer and the auxiliary additives are selected such that the hydraulic fluid composition exhibits a viscosity of at least 3 square millimeters/second at 210° F. and less than 4,000 square millimeters/second at −65° F.; and provided that the $(C_3–C_5)$alkyl (meth)acrylate of the viscosity index improving polymer is less than 60 percent n-butyl methacrylate when the $(C_{11}–C_{20})$alkyl (meth)acrylate of the viscosity index improving polymer is greater than 30 percent dodecyl-pentadecyl methacrylate or the $(C_6–C_{10})$alkyl (meth)acrylate of the viscosity index improving polymer is greater than 30 percent hexyl methacrylate, based on total polymer weight.

The present invention also provides a viscosity index improving polymer comprising as polymerized monomer units: (a) from 40 to 60 percent, based on total polymer weight, of monomer selected from one or more $(C_1–C_2)$ alkyl (meth)acrylates; (b) from zero to 10 percent, based on total polymer weight, of monomer selected from one or more $(C_3–C_5)$alkyl (meth)acrylates and $(C_6–C_{10})$alkyl (meth)acrylates; and (c) from 40 to 60 percent, based on total polymer weight, of monomer selected from one or more $(C_{11}–C_{15})$alkyl (meth)acrylates; wherein the polymer has a weight-average molecular weight from 60,000 to 350,000.

In another embodiment, the present invention provides a viscosity index improving polymer comprising as polymerized monomer units: (a) from 10 to 30 percent, based on total polymer weight, of monomer selected from one or more $(C_1–C_2)$alkyl (meth)acrylates; (b) from 30 to 50 percent, based on total polymer weight, of monomer selected from one or more $(C_3–C_5)$alkyl (meth)acrylates; (c) from zero to 10 percent, based on total polymer weight, of monomer selected from one or more $(C_6–C_{10})$alkyl (meth)acrylates; (d) from 30 to 50 percent, based on total polymer weight, of monomer selected from one or more $(C_{11–C_{15})}$alkyl (meth) acrylates; and (e) from zero to 10 percent, based on total polymer weight, of monomer selected from one or more $(C_{16}–C_{20})$alkyl (meth)acrylates; wherein the polymer has a weight-average molecular weight from 60,000 to 350,000.

DETAILED DESCRIPTION OF THE INVENTION

We have found that viscosity index (VI) improving polymer compositions of selected alkyl (meth)acrylate ester monomers, formed in selected weight ratios, can be designed to incorporate the beneficial solubility and viscosity control characteristics of each type of monomer, resulting in unexpectedly improved viscosity control and low temperature performance characteristics while maintaining good solubility in the phosphate ester fluids as compared with the conventional VI improving additives.

As used herein, the term "alkyl (meth)acrylate" refers to either the corresponding acrylate or methacrylate ester. Also, as used herein, the term "substituted" is used in conjunction with various phosphate esters to indicate that one or more hydrogens of the alkyl or aryl groups has been replaced, for example, with hydroxy, $(C_1–C_{10})$alkyl or $(C_1–C_{10})$alkyloxy groups. As used herein, all percentages referred to will be expressed in weight percent (%), based on total weight of polymer or composition involved, unless specified otherwise.

Each of the monomer types used in the VI improving polymer additive compositions of the present invention can be a single monomer or a mixture of monomers having different numbers of carbon atoms in the alkyl portion. The range of compositions for the polymers is selected to maximize viscosity index characteristics and to maintain fluid solubility of the polymer additive in the phosphate ester-based fluids, particularly at low temperatures. By low temperature is meant temperatures below about −40° C.(corresponds to −40° F.); fluidity at temperatures of −54° C. (corresponds to −65° F.) is of particular interest. Consequently, the amount of alkyl (meth)acrylate monomers used to prepare the polymeric additives is from 40 to 100% of $(C_1–C_{10})$alkyl (meth)acrylate and from zero to 60% of $(C_{11}–C_{20})$alkyl (meth)acrylate, preferably from 40 to 70% of $(C_1–C_{10})$alkyl (meth)acrylate and from 30 to 60% of $(C_{11}–C_{20})$alkyl (meth)acrylate, and more preferably, from 50 to 60% of $(C_1–C_{10})$alkyl (meth)acrylate and from 40 to 50% of $(C_{11}–C_{20})$alkyl (meth)acrylate.

The $(C_1–C_{10})$alkyl (meth)acrylate monomers may be divided into several subgroups: $(C_1–C_5)$alkyl (meth) acrylates and $(C_6–C_{10})$alkyl (meth)acrylates, and the $(C_1–C_5)$alkyl (meth)acrylates may be further divided into $(C_1–C_2)$alkyl (meth)acrylates and $(C_3–C_5)$alkyl (meth) acrylates. The amount of $(C_1–C_5)$alkyl (meth)acrylate monomer (combined amount of $(C_1–C_2)$alkyl (meth) acrylate and $(C_3–C_5)$alkyl (meth)acrylate) in the polymer composition is at least 20% and preferably greater than 30%, otherwise the resultant polymers may have poor solubility in the phosphate ester-based fluids and the additives may not be fully functional as viscosity index improvers. In order to provide optimum low temperature fluidity, the preferred amount of $(C_1–C_5)$alkyl (meth)acrylate monomer in the polymer composition is less than 90% and more preferably less than 80%.

Although the individual amount of $(C_1–C_2)$-, $(C_3–C_5)$- and $(C_6–C_{10})$alkyl (meth)acrylate type monomer units does not exceed 75%, based on total polymer weight, the combined amount of any two of these monomer types can represent up to 100% of the polymer, for example, from zero to 100%, based on total polymer weight, of monomer selected from one or more $(C_3–C_5)$alkyl (meth)acrylates and $(C_6–C_{10})$alkyl (meth)acrylates.

The $(C_1–C_2)$alkyl (meth)acrylate monomer is selected from one or more of methyl methacrylate (MMA), methyl acrylate, ethyl methacrylate and ethyl acrylate esters; preferably, the $(C_1–C_2)$alkyl (meth)acrylate monomer is methyl methacrylate. The amount of $(C_1–C_2)$alkyl (meth) acrylate monomer in the polymer composition is from zero to 75%, preferably from 10 to 60% and more preferably from 20 to 50%, based on total polymer weight. When the amount of $(C_{11}–C_{20})$alkyl (meth)acrylate monomer in the polymer composition is low, that is, from zero to about 10%, based on total polymer weight, the preferred amount of $(C_1–C_2)$alkyl (meth)acrylate monomer is from zero to 50%. When the combined amount of $(C_3–C_5)$alkyl (meth)acrylate and $(C_6–C_{10})$alkyl (meth)acrylate monomer in the polymer composition is low, that is, from zero to about 10%, based on total polymer weight, the preferred amount of $(C_1–C_2)$ alkyl (meth)acrylate monomer is from 40 to 75% and more preferably 40 to 60%, and the preferred amount of $(C_{11}–C_{20})$ alkyl (meth)acrylate monomer is from 25 to 60% and more preferably from 40 to 60%.

The $(C_3–C_5)$alkyl (meth)acrylate monomer is selected from one or more of propyl, butyl and pentyl methacrylate or acrylate esters; when used, the $(C_3–C_5)$alkyl (meth) acrylate monomer is preferably n-butyl methacrylate (BMA) or isobutyl methacrylate (IBMA). The alkyl portion of the $(C_3–C_5)$alkyl (meth)acrylate monomer may be linear (n-alkyl) or branched (for example: isobutyl, tertbutyl, isopentyl, tertamyl). The amount of $(C_3–C_5)$alkyl (meth) acrylate monomer in the polymer composition is from zero to 75%, preferably from zero to 50% and more preferably from zero to 40%, based on total polymer weight. When the amount of $(C_{11}–C_{20})$alkyl (meth)acrylate monomer in the polymer composition is low, that is, from zero to about 10%, based on total polymer weight, the preferred combined amount of ($C_1$–$C_2$)alkyl (meth)acrylate and ($C_3$–$C_5$)alkyl (meth)acrylate monomer is from 60 to 80% and the preferred amount of ($C_6$–$C_{10}$)alkyl (meth)acrylate monomer is from 20 to 40%.

Suitable ($C_6$–$C_{10}$)alkyl (meth)acrylate monomers include, for example, 2-ethylhexyl acrylate (EHA), 2-ethylhexyl methacrylate, octyl methacrylate, decyl methacrylate, isodecyl methacrylate (IDMA, based on branched ($C_{10}$)alkyl isomer mixture); when used, the ($C_6$–$C_{10}$)alkyl (meth) acrylate monomer is preferably isodecyl methacrylate (IDMA). The amount of ($C_6$–$C_{10}$)alkyl (meth)acrylate monomer in the polymer composition is from zero to 75% and preferably from zero to 50%, based on total polymer weight. When the amount of ($C_{11}$–$C_{20}$)alkyl (meth)acrylate monomer in the polymer composition is low, that is, from zero to about 10%, based on total polymer weight, the preferred amount of ($C_6$–$C_{10}$)alkyl (meth)acrylate monomer is from 25 to 50% and the preferred combined amount of ($C_1$–$C_2$)alkyl (meth)acrylate and ($C_3$–$C_5$)alkyl (meth) acrylate monomer is from 50 to 75%.

When the combined amount of ($C_1$–$C_2$)alkyl (meth) acrylate and ($C_{11}$–$C_{20}$)alkyl (meth)acrylate monomer in the polymer composition is low, that is, from zero to about 10%, based on total polymer weight, the preferred amount of ($C_3$–$C_5$)alkyl (meth)acrylate monomer is from 50 to 75% and the preferred amount of ($C_6$–$C_{10}$)alkyl (meth)acrylate monomer is from 25 to 50%.

The ($C_{11}$–$C_{20}$)alkyl (meth)acrylate monomers may divided into two groups: ($C_{11}$–$C_{15}$)alkyl (meth)acrylates and ($C_{16}$–$C_{20}$)alkyl (meth)acrylates. Suitable ($C_{11}$–$C_{15}$)alkyl (meth)acrylate monomers include, for example, undecyl methacrylate, dodecyl methacrylate (also known as lauryl methacrylate), tridecyl methacrylate, tetradecyl methacrylate (also known as myristyl methacrylate), pentadecyl methacrylate, dodecyl-pentadecyl methacrylate (DPMA, a mixture of linear and branched isomers of dodecyl, tridecyl, tetradecyl and pentadecyl methacrylates) and lauryl-myristyl methacrylate (LMA, a mixture of dodecyl and tetradecyl methacrylates). Preferred ($C_{11}$–$C_{15}$)alkyl (meth) acrylate monomers are lauryl-myristyl methacrylate, and dodecyl-pentadecyl methacrylate. The amount of ($C_{11}$–$C_{15}$) alkyl (meth)acrylate monomer in the polymer composition is from zero to 60%, preferably from 30 to 60% and more preferably from 40 to 50%, based on total polymer weight.

Use of methacrylate and acrylate ester monomers where the alkyl group contains more than 15 carbons, for example from 16 to 20 carbon atoms, generally results in poorer solubility of the VI improving additive in the phosphate ester-based fluids. For this reason, when the VI improving polymer additives of the present invention optionally contain ($C_{16}$–$C_{20}$)alkyl (meth)acrylate monomer units, they will contain less than about 20%, preferably less than 10% and more preferably from 0 to 5%, of these longer alkyl chain (meth)acrylate monomer units. These monomers include, for example, hexadecyl methacrylate, heptadecyl methacrylate, octadecyl methacrylate, nonadecyl methacrylate, cosyl methacrylate, eicosyl methacrylate, cetyl-eicosyl methacrylate (CEMA, a mixture of hexadecyl, octadecyl, cosyl and eicosyl methacrylate); and cetyl-stearyl methacrylate (SMA, a mixture of hexadecyl and octadecyl methacrylate).

The alkyl (meth)acrylate monomers containing 10 or more carbon atoms in the alkyl group are generally prepared by standard esterification procedures using technical grades of long chain aliphatic alcohols, and these commercially available alcohols are mixtures of alcohols of varying chain lengths containing between 10 and 20 carbon atoms in the alkyl group. Consequently, for the purposes of this invention, alkyl (meth)acrylate is intended to include not only the individual alkyl (meth)acrylate product named, but also to include mixtures of the alkyl (meth)acrylates with a predominant amount of the particular alkyl (meth)acrylate named. The use of these commercially available alcohols to prepare acrylate and methacrylate esters results in the LMA and DPMA monomer mixtures described above.

A preferred VI improving polymer of the present invention comprises (a) from 40 to 60% and preferably from 50 to 60%, based on total polymer weight, of monomer selected from one or more ($C_1$–$C_2$)alkyl (meth)acrylates; (b) from zero to 10% and preferably from zero to 5%, based on total polymer weight, of monomer selected from one or more ($C_3$–$C_5$)alkyl (meth)acrylates and ($C_6$–$C_{10}$)alkyl (meth) acrylates; (c) from 40 to 60% and preferably from 40 to 50%, based on total polymer weight, of monomer selected from one or more ($C_{11}$–$C_{15}$)alkyl (meth)acrylates; and (d) from zero to 10% and preferably from zero to 5%, based on total polymer weight, of monomer selected from one or more ($C_{16}$–$C_{20}$)alkyl (meth)acrylates. One preferred polymer of this type comprises 50 to 60% methyl methacrylate and 40 to 50% lauryl-myristyl methacrylate.

Another preferred VI improving polymer of the present invention comprises (a) from 10 to 30%, preferably from 15 to 25% and more preferably from 20 to 25%, based on total polymer weight, of monomer selected from one or more ($C_1$–$C_2$)alkyl (meth)acrylates; (b) from 30 to 50% and preferably from 35 to 45%, based on total polymer weight, of monomer selected from one or more ($C_3$–$C_5$)alkyl (meth) acrylates; (c) from zero to 10% and preferably from zero to 5%, based on total polymer weight, of monomer selected from one or more ($C_6$–$C_{10}$)alkyl (meth)acrylates; (d) from 30 to 50% and preferably from 35 to 45%, based on total polymer weight, of monomer selected from one or more ($C_{11}$–$C_{15}$)alkyl (meth)acrylates; and (e) from zero to 10% and preferably from zero to 5%, based on total polymer weight, of monomer selected from one or more ($C_{16}$–$C_{20}$) alkyl (meth)acrylates. One preferred polymer of this type comprises 20% to 25% methyl methacrylate, 35 to 45% n-butyl methacrylate and 35 to 45% lauryl-myristyl methacrylate.

"Phosphate ester-based fluids," as used herein, refers to organophosphate ester fluids selected from one or more substituted or unsubstituted trialkyl phosphate, dialkyl aryl phosphate, alkyl diaryl phosphate and triaryl phosphate esters where the alkyl substituents of the phosphate ester contain from 3 to 10, preferably from 4 to 8 and more preferably from 4 to 5 carbon atoms. Suitable phosphate esters useful in the present invention include, for example, tri-n-butyl phosphate, tri-isobutyl phosphate, tri-tertbutyl phosphate, dibutyl phenyl phosphate, di-isobutyl phenyl phosphate, tripropyl phosphate, tri-isopropyl phosphate, di-n-propyl phenyl phosphate, di-isopentyl phenyl phosphate, tri-secbutyl phosphate, tripentyl phosphate, tri-isopentyl phosphate (also known as tri-isoamyl phosphate), trihexyl phosphate, tricyclohexyl phosphate, tributoxyethyl phosphate, diphenyl butyl phosphate, triphenyl phosphate. Additional suitable phosphate esters include those where the aryl portion of the phosphate ester is a substituted phenyl group, for example, tolyl (also known as methylphenyl), ethylphenyl, cresyl (also known as hydroxy-tolyl), hydroxyxylyl, isopropylphenyl, isobutylphenyl and tertbutylphenyl; examples of these phosphate esters include, for example, tertbutylphenyl diphenyl phosphate, di(tertbutylphenyl) phenyl phoshpate and tri(tertbutylphenyl) phosphate. Preferably, the phosphate esters are those of tri-n-butyl phosphate and tri-isobutyl phosphate, and more preferably tri-isobutyl phosphate. Phosphate ester fluids are available commercially as the individual esters or as mixtures or blends of different esters; commercial suppliers of the phosphate ester fluids include FMC Corporation (Durad® triaryl phosphates) and Fluka Chemie AG.

Although tri-n-butyl phosphate (TBP) and tri-isobutyl phosphate (TiBP) are both used as typical base fluids in aircraft hydraulic fluids, each has different properties that may make selection of one type more appropriate in a particular application. For example, tri-isobutyl phosphate is significantly less toxic and less irritating to skin and eyes than tri-n-butyl phosphate (oral $LD_{50}$ values are much lower for TBP than for TiBP). On the other hand, hydraulic fluids based on TBP inherently have lower viscosities than those based on TiBP; thus, low temperature performance targets are more readily satisfied with fluids based on TBP. For these reasons it is desirable to provide VI improving polymer additives that perform satisfactorily in both types of phosphate ester fluids.

The amounts of individual types of phosphate ester in the phosphate ester base fluid can vary depending upon the type of phosphate ester involved. The amount of trialkyl phosphate in mixed phosphate ester base fluids is typically from 10 to 100%, preferably from 20 to 90%, more preferably at least 35% and most preferably at least 60%, based on weight of the phosphate ester fluid. The amount of dialkyl aryl phosphate in mixed phosphate ester base fluids is typically from zero to 75%, preferably from zero to 50% and more preferably from zero to 20%. The amount of alkyl diaryl phosphate in mixed phosphate ester base fluids is typically from zero to 30%, preferably from zero to 10% and more preferably from zero to 5%. The amount of triaryl phosphate in mixed phosphate ester base fluids is typically from zero to 25%, preferably from zero to 10% and more preferably zero %. Preferably, the total amount of aryl phosphate ester (sum of dialkyl aryl, alkyl diaryl and triaryl phosphate) in mixed phosphate ester base fluids is less than about 35% and more preferably less than 20%.

The hydraulic fluid compositions of the present invention contain from 0.1 to 20%, preferably from 1 to 15% and more preferably from 2 to 10%, based on total hydraulic fluid composition weight, of auxiliary additives selected from one or more antioxidants, acid scavengers and anti-erosion additives. Use of conventional auxiliary additives provides satisfactory thermal, hydrolytic and oxidative stability of the hydraulic fluid compositions under the severe use conditions to which the fluids are exposed, especially at high temperatures, thus making available the viscosity index and low temperature fluidity improvements provided by alkyl (meth)acrylate polymers of the present invention for extended periods of time.

Antioxidants useful in hydraulic fluid compositions of the present invention include, for example, trialkylphenols, polyphenols and di(alkylphenyl)amines. Typical amounts used for each of these types of antioxidants can be from about 0.1 to about 2%, based on total hydraulic fluid composition weight.

Acid scavengers may be used in hydraulic fluid compositions of the present invention to neutralize any amounts of phosphoric acid or phosphoric acid partial esters that may form in situ by hydrolysis of the phosphate ester fluid during use. Suitable acid scavengers include, for example, epoxy compounds, such as epoxycyclohexane carboxylic acid and related diepoxy derivatives. Typical amounts used for the acid scavengers can be from about 1 to about 10%, preferably from 2 to 5%, based on total hydraulic fluid composition weight.

Anti-erosion additives useful in hydraulic fluid compositions of the present invention include, for example, alkali metal salts of perfluoroalkylsulfonic acids, such as potassium perfluorooctylsulfonate. Typical amounts used for the anti-erosion additives can be from about 0.01 to about 0.1%, based on total hydraulic fluid composition weight.

In addition to the above auxiliary additives, further additives may be optionally included in the hydraulic fluid compositions. Metal corrosion inhibitors, such as benzotriazole derivatives (for copper) and dihydroimidazole derivatives (for iron), may be added to the hydraulic fluid composition at levels from about 0.01 to about 0.1%, depending on enduse conditions. Antifoaming agents, such as polyalkylsiloxane fluids, typically used at levels below about 1 part per million by weight (ppm), may also be included in the hydraulic fluid compositions.

The weight-average molecular weight ($M_w$) of the alkyl (meth)acrylate polymer additive must be sufficient to impart the desired viscosity properties to the hydraulic fluid. As the weight-average molecular weights of the polymers increase, they become more efficient thickeners; however, they can undergo mechanical degradation in particular applications and for this reason, polymer additives with $M_w$ above about 500,000 are not suitable because they tend to undergo "thinning" due to molecular weight degradation resulting in loss of effectiveness as thickeners at the higher use temperatures (for example, at 100° C.). Thus, the $M_w$ is ultimately governed by thickening efficiency, cost and the type of application. In general, polymeric hydraulic fluid additives of the present invention have $M_w$ from about 50,000 to about 500,000 (as determined by gel permeation chromatography (GPC), using poly(alkylmethacrylate) standards); preferably, $M_w$ is in the range from 60,000 to 350,000 in order to satisfy the particular use application of hydraulic fluid. Weight-average molecular weights from 70,000 up to 200,000 are preferred for aircraft hydraulic fluids.

Those skilled in the art will recognize that the molecular weights set forth throughout this specification are relative to the methods by which they are determined. For example, molecular weights determined by gel permeation chromatography (GPC) and molecular weights calculated by other methods, may have different values. It is not molecular weight per se but the handling characteristics and performance of a polymeric additive (shear stability and thickening power under use conditions) that is important. Generally, shear stability is inversely proportional to molecular weight. A VI improving additive with good shear stability (low SSI value, see below) is typically used at higher initial concentrations relative to another additive having reduced shear stability (high SSI value) to obtain the same target thickening effect in a treated fluid at high temperatures; the additive having good shear stability may, however, produce unacceptable thickening at low temperatures due to the higher use concentrations.

Conversely, although hydraulic fluids containing lower concentrations of reduced shear stability VI improving additives may initially satisfy the higher temperature viscosity target, fluid viscosity will decrease significantly with use causing a loss of effectiveness of the treated fluid in hydraulic circuit systems. Thus, the reduced shear stability VI improving additive may be satisfactory at low temperature conditions (due to its lower concentration), but it will prove to be unsatisfactory under high temperature conditions.

Therefore, polymer composition, molecular weight and shear stability of viscosity index improving additives used to treat different fluids, such as aircraft hydraulic fluids, must be selected to achieve a balance of properties in order to satisfy both high and low temperatures performance requirements.

The shear stability index (SSI) can be directly correlated to polymer molecular weight and is a measure of the percent loss in polymeric additive-contributed viscosity due to mechanical shearing and can be determined, for example, by measuring sonic shear stability for a given amount of time according to ASTM D-2603-91 (published by the American Society for Testing and Materials): polymer additive was dissolved in dibutyl phenyl phosphate (DBPP) in an amount (usually 5 to 10% solids) sufficient to provide a viscosity of approximately 4.0 square millimeters/second ($mm^2$/sec or centistokes) at 100° C. (212° F.) and the solution was then subjected to irradiation in a sonic oscillator for 16 minutes; the viscosity was measured before and after sonic shearing to determine the SSI value. In general, higher molecular weight polymers undergo the greatest relative reduction in molecular weight when subjected to high shear conditions and, therefore, these higher molecular weight polymers also exhibit the largest SSI values. Therefore, when comparing the shear stabilities of polymers, good shear stability is associated with the lower SSI values and reduced shear stability with the higher SSI values.

The SSI range for the polymers of this invention is from about 10 to about 40%, preferably from 15 to 30% and more preferably from 18 to 25%; values for SSI are usually expressed as whole numbers, although the value is a percentage. The desired SSI for a polymer can be achieved by either varying synthesis reaction conditions or by mechanically shearing the known molecular weight product polymer to the desired value. Viscosity index improving polymers of the present invention having SSI values above about 40 may initially satisfy aircraft hydraulic fluid viscosity requirements at high and low temperatures; however, the hydraulic fluids will lose their effectiveness at high temperature conditions after extended use while retaining satisfactory low temperature fluidity due to the reduced shear stability of the VI improving polymer. Viscosity index improving polymers of the present invention having SSI values below about 10 may be used to initially satisfy aircraft hydraulic fluid viscosity requirements at high temperatures; however, the hydraulic fluids may exhibit unacceptable low temperature fluidity due to the increased usage levels of the VI improving polymer required to satisfy high temperature performance. Viscosity index improving polymers of the present invention having SSI values from 10 and 40 offer a good balance of high and low temperature fluidity control without sacrificing performance at one temperature condition for satisfactory performance at the other temperature. Thus, use of a fully effective VI improving polymer additive provides a method for stabilizing the viscosity characteristics of a hydraulic fluid by balancing shear stability, high temperature thickening ability at low usage levels and low temperature fluidity without detracting from other properties; the polymer additives of the present invention effectively provide this combination of performance properties in a single polymer.

Representative of the types of shear stability that are observed for conventional lubricating oil additives of different weight-average molecular weights ($M_w$) are the following: conventional poly(methacrylate) additives having $M_w$ of 130,000, 490,000 and 880,000, respectively, would have SSI values (210° F.) of 0, 5 and 20%, respectively, based on a 2000 mile road shear test for engine oil formulations; based on a 20,000 mile high speed road test for automatic transmission fluid (ATF) formulations, the SSI values (210° F.) were 0, 35 and 50%, respectively; and based on a 100 hour ASTM D-2882-90 pump test for hydraulic fluids, the SSI values (100° F.) were 18, 68, and 76%, respectively (*Effect of Viscosity Index Improver on In-Service Viscosity of Hydraulic Fluids*, R. J. Kopko and R. L. Stambaugh, Fuel and Lubricants Meeting, Houston, Tex., Jun. 3–5, 1975, Society of Automotive Engineers).

The polydispersity index of the phosphate ester-soluble polymers of the present invention may be from 1.5 to about 15, preferably from 2 to about 4. The polydispersity index ($M_w/M_n$) is a measure of the narrowness of the molecular weight distribution with a minimum value of 1.5 and 2.0 for polymers involving chain termination via combination and disproportionation, respectively, and higher values representing increasingly broader distributions. It is preferred that the molecular weight distribution be as narrow as possible, but this is generally limited by the method of manufacture. Some approaches to providing narrow molecular weight distributions (low $M_w/M_n$) may include one or more of the following methods: anionic polymerization; continuous-feed-stirred-tank-reactor (CFSTR); low-conversion polymerization; control of temperature, initiator/monomer ratio, etc., during polymerization; and mechanical shearing, for example homogenization, of the polymer.

Polymers of the present invention having a polydispersity index from 2 to about 4 are preferred because these polymers allow more efficient use of the additive to satisfy a particular formulated hydraulic fluid viscosity specification, for example, about 5 to 10% less additive may be required to produce a viscosity of about 3 to about 4 $mm^2$/sec at about 210° F. (100° C.) in a phosphate ester fluid compared to an additive having a polydispersity index of about 10.

Viscosity control performance properties of the VI improving polymers of the present invention are directed to use in aircraft hydraulic fluids. In general the hydraulic fluid containing low use levels of VI improving additive should exhibit a viscosity of at least 3 $mm^2$/sec at about 210° F. and less than about 4,000 $mm^2$/sec, preferably less than 3,000 $mm^2$/sec and more preferably less than 2,500 $mm^2$/sec, at −65° F. (−54° C.). When improved viscosity control is required at high temperature conditions, for example, at least 4 $mm^2$/sec at 210° F., then the low temperature viscosity should be less than about 6,000 $mm^2$/sec and preferably less than 4,000 $mm^2$/sec at −65° F. When an even higher viscosity is required at high temperature conditions, for example, at least 5 $mm^2$/sec at 210° F. and at least 3 $mm^2$/sec at about 300° F. (150° C.), then the low temperature viscosity should be less than about 10,000 $mm^2$/sec, preferably less than 8,000 $mm^2$/sec and more preferably less than 6,000 $mm^2$/sec, at −65° F. (or less than about 1,500 $mm^2$/sec, preferably less than 1,000 $mm^2$/sec and more preferably less 600 $mm^2$/sec, at −40° F. (−40° C.)).

The polymers of this invention are prepared by solution polymerization by mixing the selected monomers in the presence of a polymerization initiator, a diluent and optionally a chain transfer agent. The reaction can be run under agitation in an inert atmosphere at a temperature of from about 60° to 140° C. and more preferably from 85° to 105° C. The reaction is run generally for about 4 to 10 hours or until the desired degree of polymerization has been reached. As is recognized by those skilled in the art, the time and temperature of the reaction are dependent on the choice of initiator and can be varied accordingly.

Initiators useful for this polymerization are any of the well known free-radical-producing compounds such as peroxy, hydroperoxy and azo initiators including for example, acetyl peroxide, benzoyl peroxide, lauroyl peroxide, t-butyl peroxyiso-butyrate, caproyl peroxide, cumene hydroperoxide, 1,1-di(t-butylperoxy)-3,3,5-trimethylcyclohexane, azobisisobutyronitrile and t-butyl peroctoate. The initiator concentration is normally between 0.025 and 1% by weight based on the total weight of the monomers and more preferably from 0.05 to 0.25%. Chain transfer agents may also be added to the polymerization reaction to control the molecular weight of the polymer. The preferred chain transfer agents are alkyl mercaptans such as lauryl (dodecyl) mercaptan, and the concentration of chain transfer agent used is from 0 to about 0.5% by weight.

Among the diluents suitable for the polymerization are any of the phosphate ester fluids, or mixtures thereof, that may ultimately be used in formulated hydraulic fluids containing the VI improver additive; tri-n-butyl phosphate and tri-isobutyl phosphate are preferred diluents.

After the polymerization, the resultant polymer solution has a polymer content of between about 50 to 95% by weight. The polymer can be isolated and used directly in phosphate ester fluids or the polymer-diluent solution can be used in a concentrate form. When used in the concentrate form the polymer concentration can be adjusted to any desirable level with additional diluent (phosphate ester). The preferred concentration of polymer in the concentrate is from 30 to 70% by weight. When the concentrate is to be directly blended into a hydraulic base fluid, the more preferred diluent is a phosphate ester that is compatible with the final phosphate ester-based hydraulic fluid. When a polymer of the present invention is added to hydraulic fluids, such as aircraft hydraulic fluids, whether it is added as pure polymer or as concentrate, the final concentration of polymer solids in the hydraulic fluid is from 1 to 15%, preferably from 2 to 10% and more preferably from 3 to 7%, by weight, depending on the specific use application requirements.

The polymers of the present invention were evaluated by a variety of performance tests commonly used for hydraulic fluids and they are discussed below.

Conventional engine oils containing viscosity index improvers generally have viscosity index (VI) values in the range of 120 to about 230, values greater than about 140 being preferred depending upon the blend specifications. The higher the value, the less the change in viscosity as the temperature is raised or lowered. Viscosity index improver compositions for use in aircraft hydraulic fluids of the present invention offer high viscosity index values, generally greater than about 200.

Some embodiments of the invention are described in detail in the following Examples. All ratios, parts and percentages (%) are expressed by weight unless otherwise specified, and all reagents used are of good commercial quality unless otherwise specified. Examples 1 through 11 provide information for preparing polymers and Examples 12 through 13 (Tables 1 through 15) give performance data on hydraulic fluid formulations containing the polymers. Abbreviations used in the Examples and Tables are listed below with the corresponding descriptions; polymer additive compositions are designated by the relative proportions of monomers used. Polymer identification numbers (ID#) followed by suffix "C" designate comparative polymer compositions, for example, 1-1C, and do not represent compositions of the present invention.

| | | |
|---|---|---|
| TiBP | = | Tri-isobutyl Phosphate |
| TBP | = | Tri-n-butyl Phosphate |
| TBOEP | = | Tributoxyethyl Phosphate |
| DBPP | = | Dibutyl Phenyl Phosphate |
| MMA | = | Methyl Methacrylate |
| BMA | = | n-Butyl Methacrylate |
| IBMA | = | Isobutyl Methacrylate |
| LMA | = | Lauryl-Myristyl Methacrylate |
| IDMA | = | Isodecyl Methacrylate |
| DPMA | | Dodecyl-Pentadecyl Methacrylate |
| SSI | = | Shear Stability Index |
| ΔSSI | = | Difference in SSI between 2 polymers |
| ID# | = | Polymer Identification Number (Tables) |

Polymer compositions of poly(BMA) and poly(BMA/DPMA//67/33) are representative of commercially available VI improving additives prepared by conventional solution polymerization processes. Mixtures of these polymers may also be used in aircraft hydraulic fluids in a similar fashion to the mixtures of polymers disclosed in U.S. Pat. No. 3,718,596.

EXAMPLE 1

Preparation of Poly(BMA)—Comparative

To a reactor containing 630 parts of tri-isobutyl phosphate (TiBP) and which had been inerted with nitrogen was added 30% (631 parts) of a monomer mix containing 2100 parts of n-butyl methacrylate, 3.57 parts of n-dodecylmercaptan and 2.1 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 3.15 parts of 2,2'-azobis(2-methylbutyronitrile) in 315 parts of TiBP were added over a period of 60 minutes. The reactor was then held at 95° C. for 30 minutes, 764 parts of TiBP were added and the temperature was maintained at 95° C. for an additional 30 minutes. The resultant solution contained 53.65% polymer solids which represented a 97.9% conversion of monomer to polymer. The SSI of this polymer (16 min sonic shearing) was 45. This polymer corresponds to ID# 1-1C, 2-1C and 3-1C in Tables 1, 2and 3.

EXAMPLE 2

Preparation of Poly(IBMA)—Comparative

To a reactor containing 84 parts of tri-isobutyl phosphate (TiBP) and which had been inerted with nitrogen was added 30% (63.1 parts) of a monomer mix containing 210 parts of isobutyl methacrylate, 0.25 parts of n-dodecylmercaptan and 0.21 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 0.32 parts of 2,2'-azobis(2-methylbutyronitrile) in 31.5 parts of TiBP were added over a period of 60 minutes. The reactor was then held at 95° C. for 30 minutes, 55.5 parts of TiBP were added and the temperature was maintained at 95° C. for an additional 30 minutes. The resultant solution contained 53.8% polymer solids which represented a 98.5% conversion of monomer to polymer. The SSI of this polymer (16 min sonic shearing) was 33. This polymer corresponds to ID# 3-3C in Table 3.

EXAMPLE 3

Preparation of Poly(50 BMA/50 IDMA)

To a reactor containing 105 parts of tri-isobutyl phosphate (TiBP) and which had been inerted with nitrogen was added 30% (106.7 parts) of a monomer mix containing 175 parts of n-butyl methacrylate, 179.5 parts of isodecyl methacrylate, 0.7 parts of n-dodecylmercaptan and 0.35 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 0.53 parts of 2,2'-azobis(2-methylbutyronitrile) in 52.5 parts of TiBP were added over a period of 60 minutes. The reactor was then held at 95° C. for 30 minutes, 122.8 parts of TiBP were added and the temperature was maintained at 95° C. for an additional 30 minutes. The resultant solution contained 53.4% polymer solids which represented a 98.7% conversion of monomer to polymer. The SSI of this polymer (16 min sonic shearing) was 28. This polymer corresponds to ID# 1-5, 2-4 and 3-6 in Tables 1, 2 and 3.

EXAMPLE 4

Preparation of Poly(50 MMA/50 IDMA)

To a reactor containing 105 parts of tri-isobutyl phosphate (TiBP) and which had been inerted with nitrogen was added 30% (106.9 parts) of a monomer mix containing 175 parts of methyl methacrylate, 179.5 parts of isodecyl methacrylate, 1.4 parts of n-dodecylmercaptan and 0.35 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 0.53 parts of 2,2'-azobis(2-methylbutyronitrile) in 52.5 parts of TiBP were added over a period of 60 minutes. The reactor was then held at 95° C. for 30 minutes, 122.1 parts of TiBP were added and the temperature was maintained at 95° C. for an additional 30 minutes. The resultant solution contained 54.2% polymer solids which represented a 98% conversion of monomer to polymer. The SSI of this polymer (16 min sonic shearing) was 16. This polymer corresponds to ID# 1-8, 2-7 and 3-9 in Tables 1, 2 and 3.

EXAMPLE 5

Preparation of Poly(90 BMA/10 MMA)—Comparative

To a reactor containing 63 parts of tri-isobutyl phosphate (TiBP) and which had been inerted with nitrogen was added 30% (63.2 parts) of a monomer mix containing 189 parts of n-butyl methacrylate, 21 parts of methyl methacrylate, 0.53 parts of n-dodecylmercaptan and 0.21 parts of 2,2'-azobis (2-methylbutyronitrile). The reactor was heated to 95° C. and the remainder of the monomer mix was added over a period of 60 minutes. The reactor contents were then maintained at 95° C. for 30 minutes after which 0.32 parts of 2,2'-azobis(2-methylbutyronitrile) in 31.5 parts of TiBP were added over a period of 60 minutes. The reactor was then held at 95° C. for 30 minutes, 76.3 parts of TiBP were added and the temperature was maintained at 95° C. for an additional 30 minutes. The resultant solution contained 53.9% polymer solids which represented a 97.6% conversion of monomer to polymer. The SSI of this polymer (16 min sonic shearing) was 25. This polymer corresponds to ID# 3-10C in Table 3.

EXAMPLE 6

Preparation of Poly(50 BMA/50 LMA)

To a reactor containing 90 parts of tri-isobutyl phosphate (TiBP) and which had been inerted with nitrogen was added 30% (68.5 parts) of a monomer mix containing 112.5 parts of n-butyl methacrylate, 115.4 parts of lauryl-myristyl methacrylate (LMA), 0.18 parts of n-dodecylmercaptan and 0.23 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 0.34 parts of 2,2'-azobis(2-methylbutyronitrile) in 33.75 parts of TiBP were added over a period of 60 minutes. The reactor was then held at 95° C. for 30 minutes, 56.7 parts of TiBP were added and the temperature was maintained at 95° C. for an additional 30 minutes. The resultant solution contained 54% polymer solids which represented a 98% conversion of monomer to polymer. The SSI of this polymer (16 min sonic shearing) was 39. This polymer corresponds to ID# 1-9 and 3-15 in Tables 1 and 3.

EXAMPLE 7

Preparation of Poly(20 MMA/40 BMA/40 LMA)

To a reactor containing 90 parts of tri-isobutyl phosphate (TiBP) and which had been inerted with nitrogen was added 30% (68.3 parts) of a monomer mix containing 90 parts of n-butyl methacrylate, 92.3 parts of lauryl-myristyl methacrylate (LMA), 45 parts of methyl methacrylate, 0.23 parts of n-dodecylmercaptan and 0.23 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 0.34 parts of 2,2'-azobis (2-methylbutyronitrile) in 33.75 parts of TiBP were added over a period of 60 minutes. The reactor was then held at 95° C. for 30 minutes, 57.25 parts of TiBP were added and the temperature was maintained at 95° C. for an additional 30 minutes. The resultant solution contained 53.1% polymer solids which represented a 96.4% conversion of monomer to polymer. The SSI of this polymer (16 min sonic shearing) was 45. This polymer corresponds to ID# 3-18, 4-1 and 5-3 in Tables 3, 4 and 5.

EXAMPLE 8

Preparation of Poly(20 MMA/40 BMA/40 LMA).

To a reactor containing 1900 parts of tri-n-butyl phosphate (TBP) and which had been inerted with nitrogen was added 30% (2894 parts) of a monomer mix containing 3800 parts of n-butyl methacrylate, 3897 parts of lauryl-myristyl methacrylate (LMA), 1900 parts of methyl methacrylate, 39.9 parts of n-dodecylmercaptan and 9.5 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 14.25 parts of 2,2'-azobis(2-methylbutyronitrile) in 1900 parts of TBP were added over a period of 60 minutes. The reactor was then held at 95° C. for 30 minutes, 2862 parts of TBP were added and the temperature was maintained at 95° C. for an additional 30 minutes. The resultant solution contained 53% polymer solids which represented a 96.3% conversion of monomer to polymer. The SSI of this polymer (16 min sonic shearing) was 17. This polymer corresponds to ID# 7-2 in Table 7.

EXAMPLE 9

Preparation of Poly(50 MMA/50 LMA)

To a reactor containing 540 parts of tri-isobutyl phosphate (TiBP) and which had been inerted with nitrogen was added 30% (368 parts) of a monomer mix containing 615.4 parts of lauryl-myristyl methacrylate (LMA), 600.9 parts of methyl methacrylate, 4.08 parts of n-dodecylmercaptan and 6 parts of 20% 2,2'-azobis(2-methylbutyronitrile) in TiBP. The reactor was heated to 95° C. and the remainder of the monomer mix was added over a period of 60 minutes. The reactor contents were then maintained at 95° C. for 30 minutes after which 9 parts of 20% 2,2'-azobis(2-methylbutyronitrile) in TiBP were added over a period of 60 minutes. The reactor was then held at 95° C. for 30 minutes, 625 parts of TiBP were added and the temperature was maintained at 95° C. for an additional 30 minutes. The resultant solution contained 48.9% polymer solids which represented a 97.7% conversion of monomer to polymer. The SSI of this polymer (16 min sonic shearing) was 17.

EXAMPLE 10

Preparation of Poly(50 MMA/50 LMA)

To a reactor containing 140 parts of tri-n-butyl phosphate (TBP) and which had been inerted with nitrogen was added 30% (111.9 parts) of a monomer mix containing 179.5 parts of lauryl-myristyl methacrylate (LMA), 175 parts of methyl methacrylate, 0.81 parts of n-dodecylmercaptan, 17.5 parts of TBP and 0.35 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 0.35 parts of 2,2'-azobis(2-methylbutyronitrile) in 70 parts TBP were added over a period of 60 minutes. The reactor was then held at 95° C. for 30 minutes, 194.3 parts of TBP were added and the temperature was maintained at 95° C. for an additional 30 minutes. The resultant solution contained 44% polymer solids which represented a 97.3% conversion of monomer to polymer. The SSI of this polymer (16 min sonic shearing) was 40.

EXAMPLE 11

Preparation of Poly(35 MMA/65 LMA)—Comparative

To a reactor containing 340 parts of tri-butoxyethyl phosphate (TBOEP) and which had been inerted with nitrogen was added 30% (520.6 parts) of a monomer mix containing 1133.3 parts of lauryl-myristyl methacrylate (LMA), 595 parts of methyl methacrylate, 5.1 parts of n-dodecylmercaptan and 1.87 parts of 2,2'-azobis(2-methylbutyronitrile). The reactor was heated to 95° C. and the remainder of the monomer mix was added over a period of 60 minutes. The reactor contents were then maintained at 95° C. for 30 minutes after which 2.55 parts of 2,2'-azobis (2-methylbutyronitrile) in 255 parts TBOEP were added over a period of 60 minutes. The reactor was then held at 95° C. for 30 minutes, 1209 parts of TBOEP were added and the temperature was maintained at 95° C. for an additional 30 minutes. The resultant solution contained 47.2% polymer solids which represented a 98.1% conversion of monomer to polymer. The SSI of this polymer (16 min sonic shearing) was 25.

EXAMPLE 12

Viscosity Measurements (High and Low Temperature Properties)

Fluid viscosity (kinematic viscosity) as a function of temperature was measured by methods according to ASTM D-445 dealing with viscosity measurement in the 150 to −54° C. temperature range (approximately 30 minute temperature equilibration times).

Tables 1 through 14 contain data for different polymer additives, using several different phosphate ester base fluids (Blend Fluids, described below). Polymer Diluent Fluid refers to the fluid that was used as diluent to prepare and formulate the polymeric additive composition. The polymeric additive in diluent (approximately 35 to 55% polymer solids) was added in the required amount (Use Level, % diluent solution) to a Blend Fluid to satisfy the particular high temperature viscosity target of interest (for example, 3 to 5 $mm^2$/sec (centistokes) at 210° F.); viscosities (expressed in $mm^2$/sec) were then measured on the solution at the lower temperatures.

| | |
|---|---|
| Fluid A | TiBP/7% triaryl phosphate/3% acid scavenger |
| Fluid B | TiBP/7% triaryl phosphate/7% acid scavenger |
| Fluid C | TiBP/13% triaryl phosphate/6% acid scavenger |
| Fluid D | TiBP/5% TBP/13% triaryl phosphate/6% acid scavenger |
| Fluid E | TiBP/8% TBP/13% triaryl phosphate/6% acid scavenger |
| Fluid F | TiBP/10% TBP/13% triaryl phosphate/6% acid scavenger |
| Fluid G | TiBP/10% TBP/13% triaryl phosphate |
| Fluid H | TiBP/15% TBP/13% triaryl phosphate/5% acid scavenger |
| Fluid J | TiBP/15% TBP/12% triaryl phosphate/6% acid scavenger |
| Fluid K | TiBP/13% trialkyl phosphate/10% triaryl phosphate/6% acid scavenger |
| Fluid L | TiBP/aryl phosphate/conventional additives |
| Fluid M | TBP/29% DBPP |

Simulated aircraft hydraulic fluid formulations (Fluids A–M) believed to be representative of the broad range of aircraft hydraulic fluids likely to be encountered in commercial aircraft were used to test the efficacy of the polymer additives of the present invention. Each of the phosphate ester base fluid formulations contained about 5 to about 15% of the VI improving polymer additive being tested, up to about 30% of additional phosphate ester material and up to about 7% of epoxy-type acid scavenger additives.

Polymer compositions of the present invention show improved low temperature fluidity when directly compared to prior art polymers having similar shear stability properties. Tables 1–14 divide these comparisons into the different types of phosphate ester blend fluids used since the composition of the latter is an important factor in detecting performance differences among the polymer additives. Comparisons are made in the same type phosphate ester fluid and at polymer concentrations adjusted to satisfy the same initial high temperature viscosity target.

Where a direct comparison of a polymer composition of the present invention with that of the prior art having the same or similar shear stability (SSI values within 1–3 units) is not available, an indirect comparison can be made. A polymer having a higher SSI value usually requires a lower use level to satisfy the initial high temperature viscosity target than does a lower SSI value polymer. In a comparison between polymers having significantly different shear stabilities, that is, different SSI values ($\Delta SSI \geqq$ about 5 units), the lower SSI value polymer should generate a greater low temperature viscosity if the two polymers are otherwise similar. However, if the low temperature viscosity of the lower SSI value polymer is similar to or less than that of the higher SSI polymer then the performance of the former represents an improvement in low temperature fluidity; this improvement is indicated since the higher use level of the lower SSI value polymer did not produce the "expected increase" in low temperature viscosity. The "improved" polymer compositions may then be used at sufficiently high use levels to satisfy high temperature requirements while maintaining low temperature fluidity.

TABLE 1

Blend Fluid = A
Polymer Diluent Fluid = TiBP
210° F. Viscosity Target = 3 $mm^2$/sec

| ID# | Composition | SSI | Use Level | Viscosity 210° F. | Viscosity −65° F. |
|---|---|---|---|---|---|
| 1-1C | 100 BMA | 45 | 5.4 | 3.0 | 2,375 |
| 1-2C | 100 BMA | 35 | 8.3 | 3.0 | 2,874 |
| 1-3C | 100 IBMA | 28 | 6.5 | 3.1 | 3,203 |
| 1-4 | 25 BMA/75 IDMA | 36 | 6.9 | 3.1 | 2,732 |
| 1-5 | 50 BMA/50 IDMA | 28 | 8.9 | 3.25 | 3,241 |
| 1-6 | 75 BMA/25 IDMA | 29 | 7.7 | 3.1 | 3,055 |
| 1-7 | 33 MMA/67 IDMA | 21 | 9.0 | 3.1 | 3,350 |
| 1-8 | 50 MMA/50 IDMA | 16 | 8.6 | 3.0 | 3,215 |
| 1-9 | 50 BMA/50 LMA | 39 | 6.9 | 3.05 | 2,241 |
| 1-10 | 20 MMA/40 BMA/40 LMA | 35 | 6.9 | 3.2 | 2,488 |

Polymer 1–4 shows a 5% viscosity (low temperature) reduction when directly compared to 1-2C, 1-5 viscosity is similar to 1-3C, 1-6 viscosity is 5% less than 1-3C, and 1-10 viscosity is 13% less than 1-2C. Indirect comparisons: 1-7 and 1-8 viscosities are within 0-5% of 1-3C.(ΔSSI=+7 to 12); 1-10 viscosity is within 5% of 1-1C (ΔSSI=+10); and 1-9 viscosity is 6% less than 1-1C (ΔSSI=+6).

TABLE 2

Blend Fluid = B
Polymer Diluent Fluid = TiBP
210° F. Viscosity Target = 3 $mm^2$/sec

| ID# | Composition | SSI | Use Level | Viscosity 210° F. | Viscosity −65° F. |
|---|---|---|---|---|---|
| 2-1C | 100 BMA | 45 | 5.2 | 3.0 | 2,712 |
| 2-2C | 100 BMA | 35 | 8.0 | 3.0 | 3,204 |
| 2-3C | 100 IBMA | 28 | 6.3 | 3.1 | 3,675 |
| 2-4 | 50 BMA/50 IDMA | 28 | 8.6 | 3.2 | 3,606 |
| 2-5 | 75 BMA/25 IDMA | 29 | 7.5 | 3.1 | 3,399 |
| 2-6 | 33 MMA/67 IDMA | 21 | 8.7 | 3.1 | 3,819 |
| 2-7 | 50 MMA/50 IDMA | 16 | 8.3 | 2.9 | 3,622 |

Polymer 2-4 shows a 2% viscosity (low temperature) reduction when directly compared to 2-3C, and 2-5 viscosity is 8% less than 2-3C. Indirect comparisons: 2-6 and 2-7 viscosities are within −1 to 4% of 2-3C (ΔSSI=+7 to 12).

TABLE 3

Blend Fluid = C
Polymer Diluent Fluid = TiBP
210° F. Viscosity Target = 3 $mm^2$/sec

| ID# | Composition | SSI | Use Level | Viscosity 210° F. | Viscosity −65° F. |
|---|---|---|---|---|---|
| 3-1C | 100 BMA | 45 | 4.9 | 3.0 | 3,055 |
| 3-2C | 100 BMA | 35 | 7.4 | 3.0 | 3,279 |
| 3-3C | 100 IBMA | 33 | 5.5 | 3.0 | 3,825 |
| 3-4C | 100 IBMA | 28 | 5.9 | 3.1 | 4,045 |
| 3-5 | 25 BMA/75 IDMA | 36 | 6.9 | 3.2 | 2,953 |
| 3-6 | 50 BMA/50 IDMA | 28 | 8.3 | 3.2 | 4,185 |
| 3-7 | 75 BMA/25 IDMA | 29 | 7.2 | 3.15 | 3,998 |
| 3-8 | 33 MMA/67 IDMA | 21 | 8.4 | 3.15 | 4,444 |
| 3-9 | 50 MMA/50 IDMA | 16 | 8.0 | 3.0 | 4,245 |
| 3-10C | 10 MMA/90 BMA | 25 | 6.1 | 3.0 | 3,242 |
| 3-11 | 25 MMA/75 BMA | 25 | 6.4 | 3.0 | 3,390 |
| 3-12 | 25 MMA/75 BMA | 36 | 5.7 | 3.0 | 3,725 |

TABLE 3-continued

Blend Fluid = C
Polymer Diluent Fluid = TiBP
210° F. Viscosity Target = 3 $mm^2$/sec

| ID# | Composition | SSI | Use Level | Viscosity 210° F. | Viscosity −65° F. |
|---|---|---|---|---|---|
| 3-13 | 55 MMA/45 BMA | 23 | 6.4 | 2.9 | 3,210 |
| 3-14 | 55 MMA/45 BMA | 10 | 9.0 | 3.0 | 4,092 |
| 3-15 | 50 BMA/50 LMA | 39 | 6.5 | 3.2 | 2,911 |
| 3-16 | 50 BMA/50 LMA | 27 | 7.8 | 3.2 | 3,204 |
| 3-17 | 50 BMA/50 LMA | 23 | 8.0 | 3.1 | 3093 |
| 3-18 | 20 MMA/40 BMA/40 LMA | 45 | 5.2 | 3.1 | 2,942 |
| 3-19 | 20 MMA/40 BMA/40 LMA | 35 | 5.9 | 3.0 | 2,901 |
| 3-20 | 20 MMA/45 BMA/35 LMA | 29 | 6.9 | 3.05 | 3,184 |
| 3-21 | 20 MMA/60 BMA/20 LMA | 26 | 6.8 | 3.0 | 3,211 |

Polymer 3-5 shows a 10% viscosity (low temperature) reduction when directlycompared to 3-2C and 13% lower viscosity than 3-3C, 3-6 viscosity is within 3% of 3-4C, 3-7 viscosity is 1% less than 3-4C, 3-11 viscosity is 16% less than 3-4C, 3-12 viscosity is within 14% of 3-2C, 3-16 viscosity is 21% less than 3-4C, 3-18 viscosity is 4% less than 3-1C, 3-19 viscosity is 12% less than 3-2C and 24% less than 3-3C, and 3-20 and 3-21 viscosities are each 21% less than 3-4C. Indirect comparisons: 3-5 and 3-15 viscosities are 3–5% less than 3-1C. (ΔSSI=+6 to 9); 3-13 viscosity is 21% less than 3-4C (ΔSSI=+5), 3-14 viscosity is similar to 3-4C (ΔSSI=+18), 3-17 viscosity is 19% less than 3-3C (ΔSSI=+10) and 6% less than 3-2C (ΔSSI=+12); and 3-8 and 3-9 viscosities are within 5–10% of 3-4C (ΔSSI=+7 to 12).

The data in Tables 4, 5, 6 and 7 demonstrate the ability of poly(MMA/BMA/LMA//20/40/40) compositions to provide excellent low temperature fluidity, that is, viscosity below about 2,500 $mm^2$/sec, while satisfying high temperature viscosity requirements over a wide range of shear stability (SSI values from 17 to 59) in both TBP and TiBP fluids.

TABLE 4

Blend Fluid = D (4-1 & 4-3), E (4-2 & 4-4), G (4-5)
Polymer Diluent Fluid = TiBP
210° F. Viscosity Target = 3 $mm^2$/sec

| ID# | Composition | SSI | Use Level | Viscosity 210° F. | Viscosity −65° F. |
|---|---|---|---|---|---|
| 4-1 | 20 MMA/40 BMA/40 LMA | 45 | 5.2 | 3.1 | 2,509 |
| 4-2 | 20 MMA/40 BMA/40 LMA | 45 | 5.3 | 3.1 | 2,461 |
| 4-3 | 20 MMA/40 BMA/40 LMA | 35 | 5.9 | 2.95 | 2,564 |
| 4-4 | 20 MMA/40 BMA/40 LMA | 35 | 6.0 | 2.9 | 2,440 |
| 4-5 | 20 MMA/40 BMA/40 LMA | 35 | 6.1 | 3.0 | 2,219 |

TABLE 5

Blend Fluid = F
Polymer Diluent Fluid = TiBP
210° F. Viscosity Target = 3 $mm^2$/sec

| ID# | Composition | SSI | Use Level | Viscosity 210° F. | Viscosity −65° F. |
|---|---|---|---|---|---|
| 5-1 | 20 MMA/40 BMA/40 LMA | 59 | 4.15 | 3.15 | 2,150 |
| 5-2 | 20 MMA/40 BMA/40 LMA | 52 | 4.75 | 3.1 | 2,118 |
| 5-3 | 20 MMA/40 BMA/40 LMA | 45 | 5.3 | 3.1 | 2,210 |
| 5-4 | 20 MMA/40 BMA/40 LMA | 35 | 6.0 | 3.0 | 2,270 |

TABLE 6

Blend Fluid = H (6-1), J (6-2 to 6-5)
Polymer Diluent Fluid = TiBP
210° F. Viscosity Target = 3–3.5 $mm^2$/sec

| ID# | Composition | SSI | Use Level | Viscosity 210° F. | Viscosity −65° F. |
|---|---|---|---|---|---|
| 6-1 | 20 MMA/40 BMA/40 LMA | 35 | 6.5 | 3.1 | 2,044 |
| 6-2 | 20 MMA/40 BMA/40 LMA | 35 | 6.5 | 3.1 | 1,982 |
| 6-3 | 20 MMA/40 BMA/40 LMA | 21 | 9.1 | 3.2 | 2,319 |
| 6-4 | 20 MMA/40 BMA/40 LMA | 19 | 10.3 | 3.5 | 2,684 |
| 6-5 | 20 MMA/40 BMA/40 LMA | 19 | 9.5 | 3.3 | 2,422 |

TABLE 7

Blend Fluid = K
Polymer Diluent Fluid = TBP
210° F. Viscosity Target = 3–3.5 $mm^2$/sec

| ID# | Composition | SSI | Use Level | Viscosity 210° F. | Viscosity −65° F. |
|---|---|---|---|---|---|
| 7-1 | 20 MMA/40 BMA/40 LMA | 18 | 9.8 | 3.3 | 2,009 |
| 7-2 | 20 MMA/40 BMA/40 LMA | 17 | 10.1 | 3.2 | 1,884 |
| 7-3 | 20 MMA/40 BMA/40 LMA | 17 | 10.1 | 3.2 | 1,915 |

TABLE 8

Blend Fluid = L
Polymer Diluent Fluid = TiBP-DBPP
210° F. Viscosity Target = 4 $mm^2$/sec

| ID# | Composition | SSI | Use Level | Viscosity 210° F. | Viscosity −65° F. |
|---|---|---|---|---|---|
| 8-1C | 30 MMA/70 LMA | 27 | 13.4 | 3.9 | Solid |
| 8-2 | 40 MMA/60 LMA | 22 | 14.0 | 3.9 | 3,466 |
| 8-3 | 50 MMA/50 LMA | 23 | 13.2 | 3.9 | 3,061 |
| 8-4 | 57 MMA/43 LMA | 23 | 10.0 | 3.9 | 2,917 |

The data in Table 8 demonstrate the effectiveness of poly(MMA/LMA) compositions containing less than 70% LMA in providing good low temperature fluidity, that is, viscosity below about 4,000 $mm^2$/sec, when the high temperature viscosity requirement is increased to about 4 $mm^2$/sec.

TABLE 9

Blend Fluid = L
Polymer Diluent Fluid = TiBP-DBPP
210° F. Viscosity Target = 5 $mm^2$/sec

| ID# | Composition | SSI | Viscosity −65° F. |
|---|---|---|---|
| 9-1C | 100 IBMA | 20/30* | 10,810 |
| 9-2C | 80 IBMA/20 IDMA | 21/27* | 10,506 |
| 9-3 | 50 IBMA/50 IDMA | 23 | 8,876 |
| 9-4 | 67 IBMA/33 IDMA | 24 | 5,535 |
| 9-5 | 67 IBMA/33 LMA | 25 | 7,533 |
| 9-6C | 30 MMA/70 LMA | 20/33* | Solid |
| 9-7 | 43 MMA/57 LMA | 24 | 5,294 |
| 9-8 | 43 MMA/57 LMA | 27 | 5,637 |
| 9-9 | 50 MMA/50 LMA | 22/31* | 5,858 |
| 9-10 | 57 MMA/43 LMA | 24 | 5,535 |
| 9-11 | 65 MMA/35 LMA | 23 | 7,810 |
| 9-12C | 20 MMA/80 IDMA | 24 | 7,867 |
| 9-13 | 40 MMA/60 IDMA | 23 | 7,844 |
| 9-14 | 50 MMA/50 IDMA | 25 | 8,557 |
| 9-15 | 65 MMA/35 IDMA | 25 | 8,454 |

* = mixture of 2 polymers having the indicated SSI values

The data in Table 9 demonstrate the effectiveness of various polymer compositions in providing good low temperature fluidity, that is, viscosity below about 10,000 and preferably below 8,000 $mm^2$/sec, when the high temperature viscosity requirement is increased to about 5 $mm^2$/sec.

TABLE 10

Blend Fluid = TiBP
Polymer Diluent Fluid = TiBP
302° F. Viscosity Target = 3 $mm^2$/sec
210° F. Viscosity Target = 5–6 $mm^2$/sec

| ID# | Composition | SSI | Viscosity 302° F. | Viscosity 210° F. | Viscosity −40° F. | Viscosity −65° F. |
|---|---|---|---|---|---|---|
| 10-1 | 67 IBMA/33 IDMA | 24 | 3.1 | 5.3 | 1,443 | 9,399 |
| 10-2C | 100 BMA | 25 | 3.1 | 5.7 | 1,896 | — |
| 10-3C | 67 BMA/33 DPMA | 21 | 3.1 | 5.7 | 1,697 | 10,505 |

Polymer 10-1 shows a 24% viscosity reduction when directly compared to 10-2C (−40° F.) and an 11–15% lower viscosity than 10-3C (−65° F. and −40° F., respectively).

TABLE 10A

Blend Fluid = TBP
Polymer Diluent Fluid = TBP
302° F. Viscosity Target = 3 $mm^2$/sec
210° F. Viscosity Target = 5 $mm^2$/sec

| ID # | Composition | SSI | Viscosity 302° F. | Viscosity 210° F. | Viscosity −40° F. | Viscosity −65° F. |
|---|---|---|---|---|---|---|
| 10A-1 | 67 IBMA/33 IDMA | 28 | 3.0 | 5.2 | 496 | 2,852 |
| 10A-2 | 67 IBMA/33 IDMA | 25 | 3.05 | 5.2 | 408 | 1,986 |
| 10A-3 | 67 IBMA/33 IDMA | 21 | 3.0 | 5.3 | 443 | 2,245 |
| 10A-4C | Blend of 10-2C/10-3C | 29 | 3.1 | 4.9 | 474 | 3,522 |

Polymer 10A-1 shows a 19% viscosity reduction when directly compared to 10A-4C (−65° F.). Indirect comparisons: 10A-2 and 10A-3 viscosities are 36–44% less than 10A-4C (ΔSSI=+4 to 8) at −65° F. Polymer 10A-4C is a mixture of equal parts of poly(BMA) and poly(BMA/DPMA//67/33), based on polymer solids.

TABLE 11

Blend Fluid = TBP
Polymer Diluent Fluid = TBP
302° F. Viscosity Target = 3–4 $mm^2$/sec
210° F. Viscosity Target = 6 $mm^2$/sec

| ID # | Composition | SSI* | Viscosity 302° F. | Viscosity 210° F. | Viscosity −40° F. | Viscosity −65° F. |
|---|---|---|---|---|---|---|
| 11-1 | 67 IBMA/33 IDMA | 29 | 3.5 | 5.9 | 521 | 2,352 |
| 11-2 | 67 IBMA/33 IDMA | 30 | 3.4 | 6.1 | 578 | 2,931 |
| 11-3 | 67 IBMA/33 IDMA | 22 | 3.2 | 5.5 | 561 | 3,529 |
| 11-4C | Blend of 10-2C/10-3C | 31.5 | 3.75 | 6.4 | 715 | 5,327 |

* = SSI determined in TBP (16 min shear) - polymer added to give approximately 2.8 $mm^2$/sec viscosity at 302° F.

Polymer 11-1 shows a 51% viscosity reduction when directly compared to 11-4C (−65° F.) and 11-2 viscosity is 45% less than 11-4C. Indirect comparisons: 11-3 viscosity is 34% less than 11-4C (ΔSSI=+9) at −65° F. Polymer 11-4C is a mixture of equal parts of poly(BMA) and poly(BMA/DPMA//67/33), based on polymer solids.

TABLE 12

Blend Fluid = M
Polymer Diluent Fluid = TBP
302° F. Viscosity Target = 3$mm^2$/sec
210° F. Viscosity Target = 5 $mm^2$/sec

| ID # | Composition | SSI | Viscosity 302° F. | Viscosity 210° F. | Viscosity −40° F. | Viscosity −65° F. |
|---|---|---|---|---|---|---|
| 12-1 | 67 IBMA/33 LMA | 24 | 3.0 | 4.9 | 415 | 1,916 |
| 12-2 | 67 IBMA/33 LMA | 24 | 2.9 | 4.85 | 468 | 1,825 |
| 12-3C | Blend of 10-2C/10-3C | 31 | 3.1 | 5.4 | 499 | 2,065 |

Indirect comparisons: 12-1 and 12-2 viscosities are 7–12% less than 12-3C (ΔSSI=+13) at −65° F. and 6–17% less at −40° F. Polymer 12-3C is a mixture of equal parts of poly(BMA) and poly(BMA/DPMA//67/33), based on polymer solids.

TABLE 13

Blend Fluid = L
Polymer Diluent Fluid = TiBP-DBPP
302° F. Viscosity Target = 2 $mm^2$/sec
210° F. Viscosity Target = 3–4 $mm^2$/sec

| ID # | Composition | SSI* | Viscosity 302° F. | Viscosity 210° F. | Viscosity −65° F. |
|---|---|---|---|---|---|
| 13-1 | 50 MMA/50 LMA | 29 | 2.2 | 3.9 | 3,788 |
| 13-2 | 50 MMA/50 LMA | 31 | 1.9 | 3.3 | 2,678 |
| 13-3 | 50 MMA/50 LMA | 27 | 1.8 | 3.2 | 2,590 |
| 13-4C | Blend of 10-2C/10-3C | 31 | 2.2 | 4.0 | 4,022 |
| 13-5C | Blend of 10-2C/10-3C | 35 | 1.8 | 3.1 | 2,588 |

* = SSI determined in Blend Fluid L (16 min shear) - polymer added to give approximately 4 $mm^2$/sec viscosity at 302° F.

Polymer 13-1 shows a 6% viscosity reduction (low temperature) when directly compared to 13-4C. Indirect comparisons: 13-2 viscosity is within 3% of 13-5C (ΔSSI=+4) and 13-3 viscosity is similar to 13-5C (ΔSSI=+8). Polymers 13-4C and 13-5C are mixtures of equal parts of poly(BMA) and poly(BMA/DPMA//67/33), based on polymer solids.

TABLE 14

Blend Fluid = TiBP
Polymer Diluent Fluid = TiBP
302° F. Viscosity Target = 3 $mm^2$/sec
210° F. Viscosity Target = 5–6 $mm^2$/sec

| ID # | Composition | SSI | Use Level | Viscosity 302° F. | Viscosity 210° F. | Viscosity −40° F. |
|---|---|---|---|---|---|---|
| 14-1 | 67 IBMA/33 IDMA | 24 | 15.7 | 3.0 | 5.0 | 1,558 |
| 14-2 | 70 IBMA/30 MMA | 23 | 14.2 | 3.0 | 5.7 | 2,757 |

Although both polymers exhibit satisfactory low temperature fluidity, polymer 14-1 shows a 43% viscosity reduction (low temperature) when directly compared to 14-2. This demonstrates that the preferred amounts of ($C_1$–$C_5$)alkyl (meth)acrylate monomer in the polymer composition are less than about 90% and more preferably less than about 80% (100% in 14-2 and 67% in 14-1).

EXAMPLE 13

Viscosity Index Improving Polymer Compatibility

Table 15 contains compatibility data on various polymer additive compositions that were used in phosphate ester fluid formulations. the polymer additive solutions are the same solutions tested and described in Table 9. The polymers were dissolved in Blend Fluid L at a polymer solids level sufficient to provide a viscosity of approximately 5 $mm^2$/sec at 210° F. The test solutions were then stored for 72 hours at −54° C. and then visually examined. Compatibility ratings in the Table correspond to satisfactory compatibility, that is, clear, homogeneous solutions (OK) and to unsatisfactory compatibility, that is, hazy or phase separated solutions (Poor). Polymers 15-8C and 15-9C correspond to compositions with unsatisfactory low temperature solubility. Other polymer compositions appeared to have satisfactory low temperature solubility, but were deficient or marginal in viscosity control performance (15-10C and 15-11C in Table 15 correspond to polymers 9-1C and 9-2C, respectively, in Table 9).

TABLE 15

| ID# | Composition | Compatibility |
|---|---|---|
| 15-1 | 50 MMA/50 IDMA | OK |
| 15-2 | 40 MMA/60 IDMA | OK |
| 15-3C | 20 MMA/80 IDMA | OK |
| 15-4 | 65 MMA/35 LMA | OK |
| 15-5 | 57 MMA/43 LMA | OK |
| 15-6 | 50 MMA/50 LMA | OK |
| 15-7 | 43 MMA/57 LMA | OK |
| 15-8C | 35 MMA/65 LMA | Poor |
| 15-9C | 30 MMA/70 LMA | Poor |
| 15-10C | 100 IBMA | OK |
| 15-11C | 80 IBMA/20 IDMA | OK |
| 15-12 | 50 IBMA/50 IDMA | OK |
| 15-13 | 67 IBMA/33 IDMA | OK |
| 15-14 | 67 IBMA/33 LMA | OK |

We claim:

1. A hydraulic fluid composition comprising:

(a) a phosphate ester base fluid comprising one or more trialkyl phosphate esters, wherein alkyl groups of the phosphate ester contain 4 to 5 carbon atoms;

(b) from 1 to 15 percent, based on total hydraulic fluid composition weight, of a viscosity index improving polymer comprising monomer units of:

(i) from 40 to 100 percent, based on total polymer weight, of monomer selected from one or more ($C_1$–$C_{10}$)alkyl (meth)acrylates; wherein the ($C_1$–$C_{10}$)alkyl (meth)acrylate comprises from zero to 75 percent, based on total polymer weight, of monomer selected from one or more ($C_1$–$C_2$)alkyl (meth) acrylates; from zero to 75 percent, based on total polymer weight, of monomer selected from one or more ($C_3$–$C_5$)alkyl (meth)acrylates; from zero to 75 percent, based on total polymer weight, of monomer selected from one or more ($C_6$–$C_{10}$)alkyl (meth) acrylates; and at least 20 percent, based on total polymer weight, of combined ($C_1$–$C_2$)alkyl (meth) acrylate and ($C_3$–$C_5$)alkyl (meth)acrylate monomers; and (ii) from zero to 60 percent, based on total polymer weight, of monomer selected from one or more ($C_{11}$–$C_{20}$)alkyl (meth)acrylates; and (c) from 0.1 to 20 percent, based on total hydraulic fluid composition weight, of auxiliary additives selected from one or more antioxidants, acid scavengers and anti-erosion additives;

wherein relative amounts of the phosphate ester base fluid, the viscosity index improving polymer and the auxiliary additives are selected such that the hydraulic fluid composition exhibits a viscosity of at least 3 square millimeters/second at 210° F. and less than 4,000 square millimeters/second at −65° F.; and provided that the ($C_3$–$C_5$)alkyl (meth)acrylate of the viscosity index improving polymer is less than 60 percent n-butyl methacrylate when the ($C_{11}$–$C_{20}$)alkyl (meth)acrylate of the viscosity index improving polymer is greater than 30 percent dodecyl-pentadecyl methacrylate or the ($C_6$–$C_{10}$)alkyl (meth) acrylate of the viscosity index improving polymer is greater than 30 percent hexyl methacrylate, based on total polymer weight.

2. The hydraulic fluid composition of claim 1 wherein:

(a) the ($C_1$–$C_{10}$)alkyl (meth)acrylate monomer units of the viscosity index improving polymer comprise from zero to 75 percent, based on total polymer weight, of monomer selected from one or more ($C_1$–$C_2$)alkyl (meth)acrylates and from zero to 100 percent, based on total polymer weight, of monomer selected from one or more ($C_3$–$C_5$)alkyl (meth)acrylates and ($C_6$–$C_{10}$)alkyl (meth)acrylates; and (b) the ($C_{11}$–$C_{20}$)alkyl (meth)acrylate monomer units of the viscosity index improver comprise from zero to 60 percent, based on total polymer weight, of monomer selected from one or more ($C_{11}$–$C_{15}$)alkyl (meth) acrylates and from zero to 10 percent, based on total polymer weight, of monomer selected from one or more ($C_{16}$–$C_{20}$)alkyl (meth)acrylates.

3. The hydraulic fluid composition of claim 2 wherein the viscosity index improving polymer comprises:

(a) from 10 to 30 percent of monomer selected from one or more ($C_1$–$C_2$)alkyl (meth)acrylates;

(b) from 30 to 50 percent of monomer selected from one or more ($C_3$–$C_5$)alkyl (meth)acrylates and ($C_6$–$C_{10}$) alkyl (meth)acrylates; and (c) from 30 to 50 percent of monomer selected from one or more ($C_{11}$–$C_{15}$)alkyl (meth)acrylates;

wherein the polymer has a weight-average molecular weight from 60,000 to 350,000.

4. The hydraulic fluid composition of claim 2 wherein the viscosity index improving polymer comprises:

(a) from 40 to 60 percent of monomer selected from one or more ($C_1$–$C_2$)alkyl (meth)acrylates;

(b) from zero to 10 percent of monomer selected from one more ($C_3$–$C_5$)alkyl (meth)acrylates and ($C_6$–$C_{10}$)alkyl (meth)acrylates; and (c) from 40 to 60 percent of monomer selected from one or more ($C_{11}$–$C_{15}$)alkyl (meth)acrylates;

wherein the polymer has a weight-average molecular weight from 60,000 to 350,000.

5. The hydraulic fluid composition of claim 1 wherein the viscosity index improving polymer has a shear stability index of 10 to 40 when measured after 16 minutes sonic shear in dibutyl phenyl phosphate and the hydraulic fluid composition exhibits a viscosity of less than 2,500 square millimeters/second at −65° F.

6. The hydraulic fluid composition of claim 1 wherein the ($C_1$–$C_{10}$)alkyl (meth)acrylate is selected from one or more of methyl methacrylate, n-butyl methacrylate, isobutyl methacrylate and isodecyl methacrylate; and the ($C_{11}$–$C_{20}$)

alkyl (meth)acrylate is selected from one or more of laurylmyristyl methacrylate and dodecyl-pentadecyl methacrylate.

7. The hydraulic fluid composition of claim 1 wherein the phosphate ester base fluid comprises at least 35 percent trialkyl phosphate, based on total phosphate ester fluid weight.

8. The hydraulic fluid composition of claim 1 wherein the trialkyl phosphate is selected from one or more of tributyl phosphate and tri-isobutyl phosphate.

9. A method for stabilizing the viscosity characteristics of a hydraulic fluid comprising adding from 1 to 15 percent, based on total hydraulic fluid composition weight, of a viscosity index improving polymer to a phosphate ester base fluid wherein:

(a) the viscosity index improving polymer comprises monomer units of:

(i) from 40 to 100 percent, based on total polymer weight, of monomer selected from one or more ($C_1$–$C_{10}$)alkyl (meth)acrylates; wherein the ($C_1$–$C_{10}$)alkyl (meth)acrylate comprises from zero to 75 percent, based on total polymer weight, of monomer selected from one or more ($C_1$–$C_2$)alkyl (meth) acrylates; from zero to 75 percent, based on total polymer weight, of monomer selected from one or more ($C_3$–$C_5$)alkyl (meth)acrylates; from zero to 75 percent, based on total polymer weight, of monomer selected from one or more ($C_6$–$C_{10}$)alkyl (meth) acrylates; and at least 20 percent, based on total polymer weight, of combined ($C_1$–$C_2$)alkyl (meth) acrylate and ($C_3$–$C_5$)alkyl (meth)acrylate monomers; and (ii) from zero to 60 percent, based on total polymer weight, of a monomer selected from one or more ($C_{11}$–$C_{20}$)alkyl (meth)acrylates;

(b) the hydraulic fluid comprises:

(i) one or more trialkyl phosphate esters, wherein alkyl groups of the phosphate ester contain 4 to 5 carbon atoms; and (ii) from 0.1 to 20 percent, based on total hydraulic fluid composition weight, of auxiliary additives selected from one or more antioxidants, acid scavengers and anti-erosion additives; and (c) relative amounts of the phosphate ester base fluid, the viscosity index improving polymer and the auxiliary additives are selected such that the hydraulic fluid composition exhibits a viscosity of at least 3 square millimeters/second at 210° F. and less than 4,000 square millimeters/second at −65° F.;

and provided that the ($C_3$–$C_5$)alkyl (meth)acrylate of the viscosity index improving polymer is less than 60 percent n-butyl methacrylate when the ($C_{11}$–$C_{20}$)alkyl (meth) acrylate of the viscosity index improving polymer is greater than 30 percent dodecyl-pentadecyl methacrylate or the ($C_6$–$C_{10}$)alkyl (meth)acrylate of the viscosity index improving polymer is greater than 30 percent hexyl methacrylate, based on total polymer weight.

* * * * *